US005801488A

United States Patent [19]

Fujisawa

[11] Patent Number: 5,801,488

[45] **Date of Patent: *Sep. 1, 1998**

[54] VARIABLE ENERGY RADIO-FREQUENCY TYPE CHARGED PARTICLE ACCELERATOR

[75] Inventor: Hiroshi Fujisawa, Kyoto, Japan

[73] Assignee: Nissin Electric Co., Ltd., Kyoto-fu, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 608,738

[22] Filed: Feb. 29, 1996

[51] Int. Cl.[6] ..... H05H 9/00

[52] U.S. Cl. ..... 315/5.41; 315/505; 250/492.21

[58] Field of Search ..... 315/5, 41, 500, 315/505; 250/492.21; 313/359.1, 360.1

[56] References Cited

U.S. PATENT DOCUMENTS

| | | | |
|---|---|---|---|
| 4,596,946 | 6/1986 | Pottier | 315/505 X |
| 4,667,111 | 5/1987 | Glavish et al. | 250/492.21 |
| 4,801,847 | 1/1989 | Sakudo et al. | 315/5.41 |
| 4,851,693 | 7/1989 | Fisher | 250/492.21 |
| 5,451,847 | 9/1995 | Nakanishi | 315/505 |

FOREIGN PATENT DOCUMENTS

| | | | |
|---|---|---|---|
| 0353888 | 2/1990 | European Pat. Off. | 315/500 |
| 410346 | 1/1992 | Japan . | |
| 4184900 | 7/1992 | Japan | 315/500 |
| 5258898 | 10/1993 | Japan | 315/500 |

OTHER PUBLICATIONS

SNQ Projektbericht zum AbschluB von Phase B (Definitionsphase) Feb. 1984.

*Radio Frequency Ion Accelerator*, by N.J. Barrett, "Ion Implantation: Equipment and Techniques" Proceedings of the Fourth Int'l Conference; Berchtesgaden, Fed. Rep. of Germany Sep. 13–17, 1982.

A cw 4–rod RFQ linac by Hiroshi Fujisawa, *Nuclear Instruments and Methods in Physics Research*, Section A, 1994, pp. 23–42.

34 MHz λ/4 Spiral Resonator by H. Fujisawa et al., Bulletin of the Institute for Chemical Research, Kyoto University vol. 72, No. 1, 1994 pp. 36–44.

*Primary Examiner*—Benny T. Lee
*Assistant Examiner*—Justin P. Bettendorf
*Attorney, Agent, or Firm*—Sughrue, Mion, Zinn, Macpeak & Seas, PLLC

[57] ABSTRACT

A radio-frequency type charged particle accelerator includes a first Radio Frequency Quadrupole (RFQ) accelerator, a second RFQ accelerator and a rear stage Rf accelerator. The first RFQ accelerator has quadrupole electrodes positioned along a traveling path of a charged particle beam and bunches and accelerates the charged particle beam by receiving a radio-frequency power from a radio-frequency power source and resonating. The rear stage RF accelerator is disposed in a rear stage of the first RFQ accelerator and changes the energy of the charged particle beam by receiving the radio-frequency power from the radio-frequency power source and resonating. The second RFQ accelerator is disposed between the first RFQ accelerator, has quadrupole electrodes positioned along the traveling path of the charged particle beam and normally accelerates the charged particle beam by receiving a radio-frequency power from the radio-frequency power source and resonating. The accelerator is switched between an accelerating mode and a passing-through mode.

14 Claims, 6 Drawing Sheets

VARIABLE ENERGY RADIO-FREQUENCY TYPE CHARGED PARTICLE ACCELERATOR

BACKGROUND OF THE INVENTION

1. Field of the Invention

The present invention relates to a radio-frequency type charged particle accelerator, and in particular, to a radio-frequency type charged particle accelerator which can be used in devices such as an ion implanter and a workpiece surface modification device for impinging charged particles such as high energy ions on a workpiece.

2. Description of the Related Art

There is known an ion implanter which ionizes impurities, which are to be diffused, selectively extracts the ionized impurities by using a mass analyzing method employing a magnetic field, accelerates the ions by an electric field, and finally implants the ionized impurities into a workpiece. This kind of ion implanter is currently becoming important in manufacturing integrated circuits (ICs), since the ion implanter can implant the ionized impurities with good control of the amount and depth of the impurities; both of these factors determine the characteristics of the semiconductor devices in semiconductor manufacturing processes.

Recently, semiconductor manufacturers have been demanding an ion implanter which can accelerate ions to a MeV (mega electron volt) level of high energy. This is because it has been known that the high energy ion implantation is effective for retrograde well formation, programming in a ROM device and the like in C-MOS device manufacturing processes.

FIG. 1 shows a conventional high energy ion implanter which accelerates ions by using an RFQ (radio-frequency quadrupole) accelerator 76. The conventional high energy ion implanter comprises an ion beam generating section 71 which consists of an ion source 72 for ionizing ion source material and extracting such material as an ion beam, an analyzing magnet 73 for exclusively extracting a predetermined kind of ion by using a mass analyzing method, a lens 74 for sharply shaping the ion beam, and a high voltage power source 75 for supplying power to the ion source 72. The conventional high energy ion implanter further comprises the above-mentioned RFQ accelerator 76, disposed in a rear stage side of the ion beam generating section 71, which accelerates the ion beam leaving the beam generating section 71 to a predetermined energy level.

The RFQ accelerator 76 is provided with quadrupole electrodes **76*b* installed in an evacuated chamber 76*a* and having a modulation (or a wavy structure). The beam entrance portion of the RFQ accelerator 76 has a beam bunching portion for bunching the ion beam so as to efficiently accelerate the ion beam in the subsequent section, i.e., the accelerating portion, of the RFQ accelerator 76. Radio-frequency power having a predetermined frequency is supplied from a radio-frequency power source (not shown) to resonate the RFQ accelerator 76. Thus a quadrupole electric field is established in a right angle direction to an ion traveling path direction. At the same time, longitudinal acceleration electric fields are established with the wavy structure of the RFQ electrodes. As a result, the ion beam bunched at the beam entrance portion is simultaneously accelerated and focused by the RFQ accelerator 76**.

The resonance frequency of the RFQ accelerator 76 is fixed at a predetermined value based on the structure thereof. Therefore, the RFQ accelerator 76 can not change the energy of ion species of the same kinds. Further, the acceleration efficiency of the RFQ accelerator 76 is decreased in a region which is greater than a predetermined energy level. In order to resolve these problems, a rear stage RF (radio-frequency) accelerator 77 is further disposed in a rear stage side of the RFQ accelerator 76. Specifically a desired energy can be obtained by the rear stage RF accelerator 77 further accelerating or decelerating the beam with the predetermined energy coming from the RFQ accelerator 76. A two-gap $\lambda/4$ resonator with a drift tube or cylindrical electrode **77*b* in an evacuated chamber 77*a* can be employed as the above-mentioned rear stage RF accelerator 77**.

In the conventional accelerator, a variable range in energy of the ion beam depends on the characteristics and the structure of the rear stage RF accelerator 77. If it is necessary that the ion beam energy have a wider range, RF accelerators having a stages have to be connected with the RFQ accelerator 76. However, the total length of the combination of the RFQ accelerator 76 and the accelerators 77 becomes too long because of the multiple stages of the RF accelerators.

Further, the conventional radio-frequency accelerating device having the RFQ accelerator 76 and the RF accelerator 77 is designed so as to be operated only in a high energy region or 200 keV–3 MeV energy region in the semiconductor manufacturing field. Therefore, such accelerator can not be operated effectively in a low energy region such as 0–100 keV. That is, beam loss increases when such an accelerator is operated in the low energy region. Accordingly, when the large dose amount of the ions are implanted, the operating period becomes very long, and therefore such an accelerator is not useful. Further, a beam loss means that the ions collide against a transportation path, which may cause many problems. Such as generation of metal particles, contamination of other solids and a decreased vacuum degree caused by a gas generation. It is necessary that the ion implanter avoid such problems.

Users in the semiconductor manufacturing field have been strongly demanding a high energy ion accelerator which can be used also in a low energy region, since a high energy accelerator designed to be operated only in a high energy region is little used in mass production in comparison with the total number of ion implantation operations.

SUMMARY OF THE INVENTION

It is therefore an object of the present invention to provide a radio-frequency type charged particle accelerator which has a compact size and can have a wide variable energy.

It is another object of the present invention to provide a radio-frequency type charged particle accelerator which can be used in a low energy region in addition to a high energy region.

It is still another object of the present invention to provide a radio-frequency type charged particle accelerator which can be used in an intermediate energy region in addition to high and low energy regions.

According to the present invention, there is provided a radio-frequency type charged particle accelerator comprising first RFQ accelerating means, including quadrupole electrodes positioned along a traveling path of a charged particle beam, for bunching and accelerating the charged particle beam by receiving a radio-frequency power from a radio-frequency power source and resonating, rear stage RF means disposed in a rear stage of the first RFQ accelerating means for changing the energy of the charged particle beam by receiving the radio-frequency power from the radio-frequency power source and resonating, second RFQ accelerating means disposed between the first RFQ accelerating means and the rear stage RF means, including quadrupole electrodes positioned along the traveling path of the charged particle beam, for normally accelerating the charged particle beam by receiving a radio-frequency power from the radio-frequency power source and resonating, and means for switching between two modes, one mode of which is an accelerating mode where a predetermined accelerating radio-frequency power is supplied to the second RFQ accelerating means and another mode of which is a passing-through mode where a predetermined non-accelerating radio-frequency power is supplied to the second RFQ accelerating means.

According to another aspect of the present invention, there is provided a radio-frequency type charged particle accelerator comprising RFQ accelerating means, including quadrupole electrodes positioned along a traveling path of a charged particle beam, for normally bunching and accelerating the charged particle beam by receiving a radio-frequency power from a radio-frequency power source and resonating, rear stage RF means disposed in a rear stage of the RFQ accelerating means for normally changing the energy of the charged particle beam by receiving the radio-frequency power from the radio-frequency power source and resonating, and means for switching between two modes, one mode of which is a high energy mode where predetermined accelerating radio-frequency powers are respectively supplied to the RFQ accelerating means and the rear stage RF means and another mode of which is a low energy mode where a predetermined non-accelerating radio-frequency power is supplied to the RFQ accelerating means and no radio-frequency power is supplied to the rear stage RF means.

According to still another aspect of the present invention, there is provided a radio-frequency type charged particle accelerator comprising RFQ accelerating means, including quadrupole electrodes positioned along a traveling path of a charged particle beam, for normally bunching and accelerating the charged particle beam by receiving a radio-frequency power from a radio-frequency power source and resonating, rear stage RF means disposed in a rear stage of the RFQ accelerating means for normally changing the energy of the charged particle beam by receiving the radio-frequency power from the radio-frequency power source and resonating, said rear stage RF means including a multistage accelerators, and means for switching between first, second and third modes, the first mode being a high energy mode where predetermined accelerating radio-frequency powers are respectively supplied to the RFQ accelerating means and the rear stage RF means, the second mode being an intermediate energy mode where a predetermined non-accelerating radio-frequency power is supplied to the RFQ accelerating means, a predetermined radio-frequency power is supplied to a first stage of the multistage accelerators so as to work as a buncher and a predetermined accelerating radio-frequency power is supplied to other stages of the multistage accelerators so as to work as accelerators, and the third mode being a low energy mode where a predetermined non-accelerating radio-frequency power is supplied to the RFQ accelerating means and no radio-frequency power is supplied to the rear stage RF means.

The above and other objects and features of the present invention will be apparent from the following description made with reference to the accompanying drawings relating to preferred embodiments of the present invention.

DETAILED DESCRIPTION OF THE PREFERRED EMBODIMENTS

The present invention will now be explained with reference to preferred embodiments and the drawings.

Figure 1:
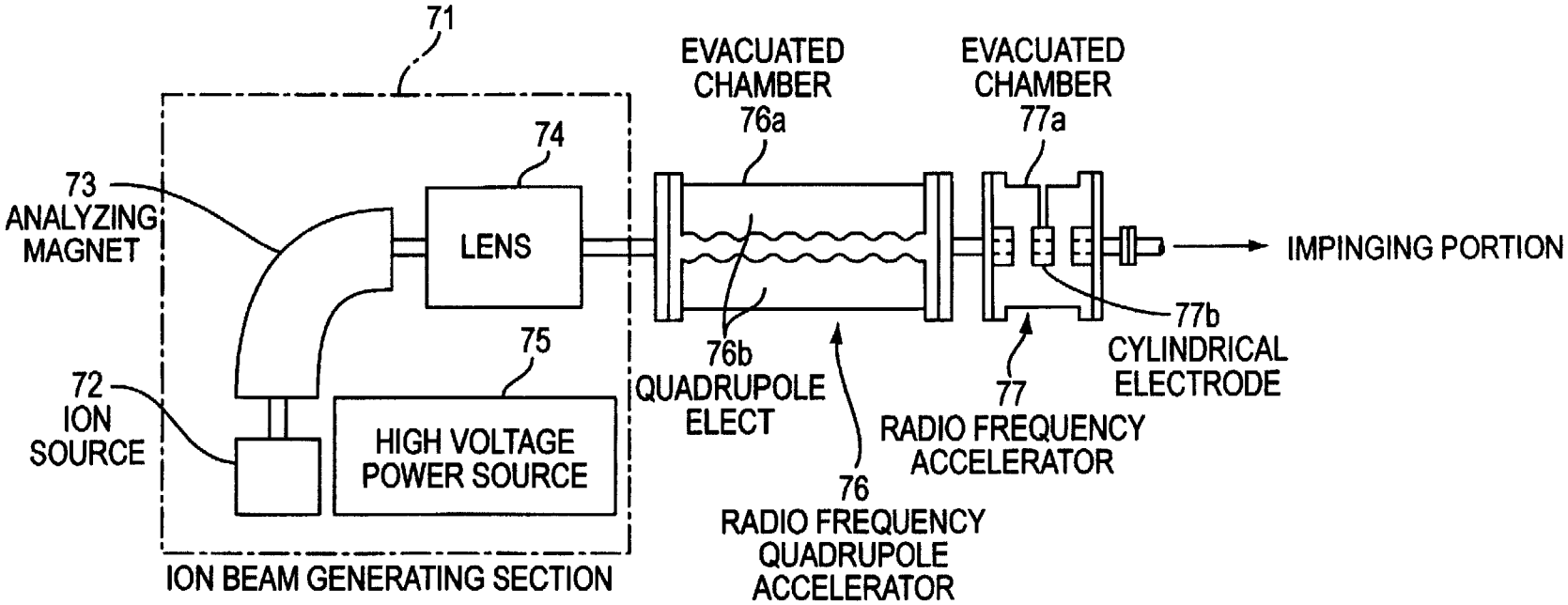
FIG. 1 (PRIOR ART)
FIG. 1 is a schematic view showing a conventional high energy ion implanter.
Figure 2:
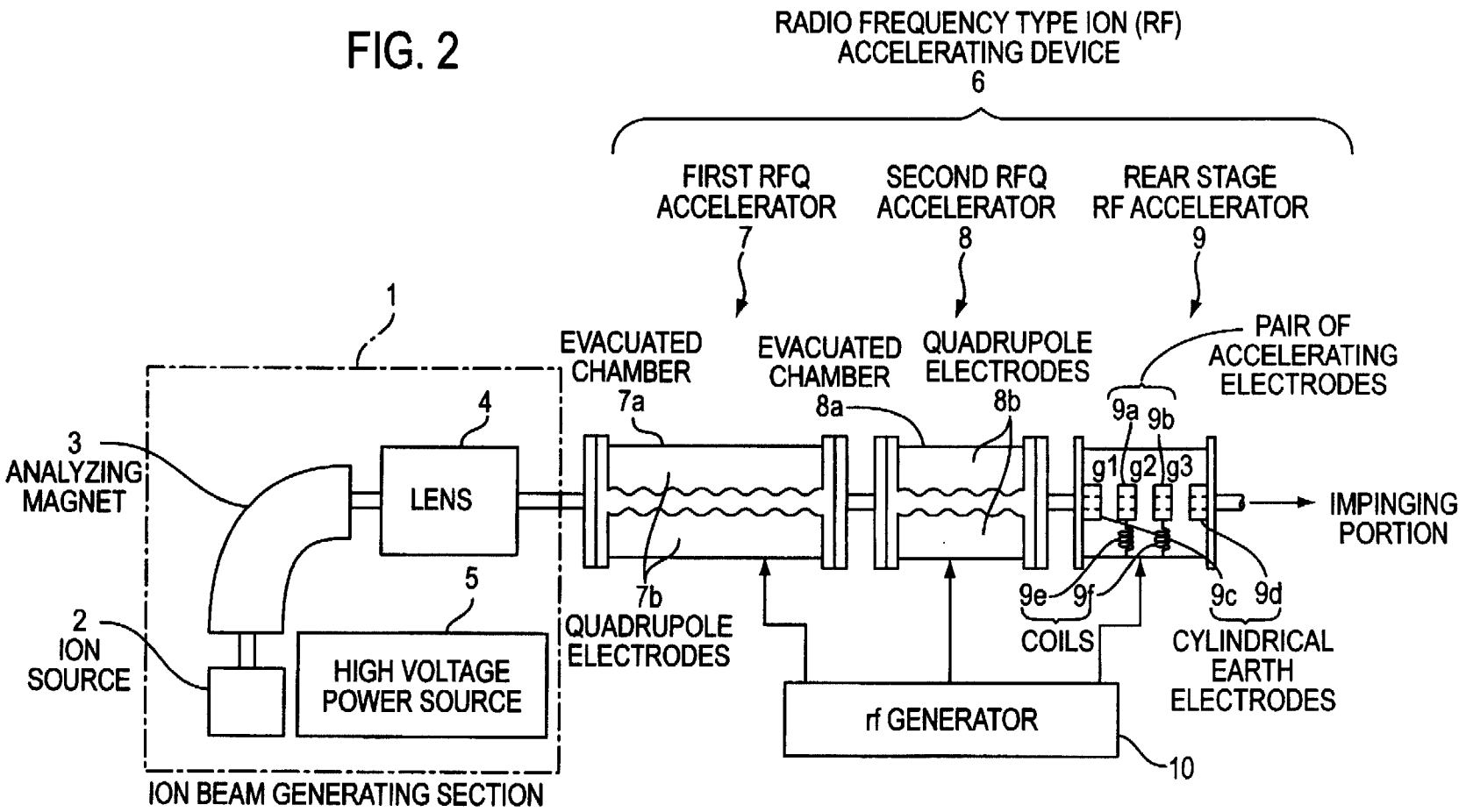
FIG. 2 is a schematic view showing a high energy ion implanter with a radio-frequency type ion accelerator which is a first embodiment of the present invention.

A first embodiment of the present invention will be explained with reference to FIGS. 2 and 3. As shown in FIG. 2, a radio-frequency type ion accelerating device 6 (hereinafter called an RF accelerating device) will be explained, such a device being a first embodiment of a radio-frequency type charged particle accelerator of the present invention. The RF accelerating device 6 is used in a high energy ion implanter, and is connected with the rear stage side of an ion beam generating section 1.

The ion beam generating section 1 includes an ion source 2 for ionizing an ion source material and extracting such material as an ion beam, an analyzing magnet 3 for exclusively extracting a predetermined kind of ions by using a mass analyzing method, an electromagnetic quadrupole lens system 4 for sharply shaping the ion beam, and a high voltage power source 5 for supplying the power to the ion source 2. The electromagnetic quadrupole lens system 4 establishes a variable magnetic field. Therefore, a permanent magnet quadrupole lens system may be employed instead of the electromagnetic quadrupole lens system 4.

The RF accelerating device 6 is composed of a first RFQ (radio frequency quadrupole) accelerator 7, a second RFQ accelerator 8 disposed in the rear stage side of the first RFQ accelerator 7, and a rear stage RF (radio-frequency) accelerator 9.

The first RFQ accelerator 7 is provided with an evacuated chamber 7*a* and quadrupole electrodes 7*b* disposed in the evacuated chamber 7*a*. The quadrupole electrodes 7*b* have a modulation or a wavy structure on surfaces thereof facing each other to establish an accelerating electric field in a direction of an ion beam traveling path. The first RFQ accelerator 7 includes a beam bunching portion in an entrance section thereof for bunching an ion beam and a beam accelerating portion in a rear side section of the beam bunching portion thereof for accelerating the ion beam.

The second RFQ accelerator 8 is provided with an evacuated chamber 8*a* and quadrupole electrodes 8*b* disposed in the evacuated chamber 8*a*. The quadrupole electrodes 8*b* have a modulation of a wavy structure on surfaces thereof facing each other to establish an accelerating electric field in a direction of the ion beam traveling path. The second RFQ accelerator 8 has only an accelerating portion as it does not need such beam bunching portion, since the bunched ion beam enters into the second RFQ accelerator 8. The structure of the accelerating portion of the second RFQ accelerator 8 is substantially the same as that of the accelerating portion of the first RFQ accelerator 7. The second RFQ accelerator 8 can be switched to work as an accelerator or to work only as a transportation tube, as explained below.

The rear stage RF accelerator 9 has a triple-gap λ/4 resonator type accelerating and decelerating structure. The rear stage RF accelerator 9 includes a pair of accelerating electrodes 9*a* and 9*b* forming cylindrical drift tubes, two cylindrical earth electrodes 9*c* and 9*d* disposed on both sides of the accelerating electrodes 9*a* and 9*b*, and two coils 9*e* and 9*f* having lengths of about one quarter of λ(λ denotes the wavelength of resonance frequency). One end of the coil 9*e* is connected to the accelerating electrode 9*a* and one end of the coil 9*f* is connected to the accelerating electrode 9*b* while their other ends are kept at ground potential.

The RF accelerating device 6 further includes a radio-frequency power source or a rf generator 10 for supplying a rf power to the first RFQ accelerator 7, the second RFQ accelerator 8 and the rear stage RF accelerator 9. The rf power supplied to the second RFQ accelerator 8 can be switched to a large value and a small value, as explained below.

Figure 3:
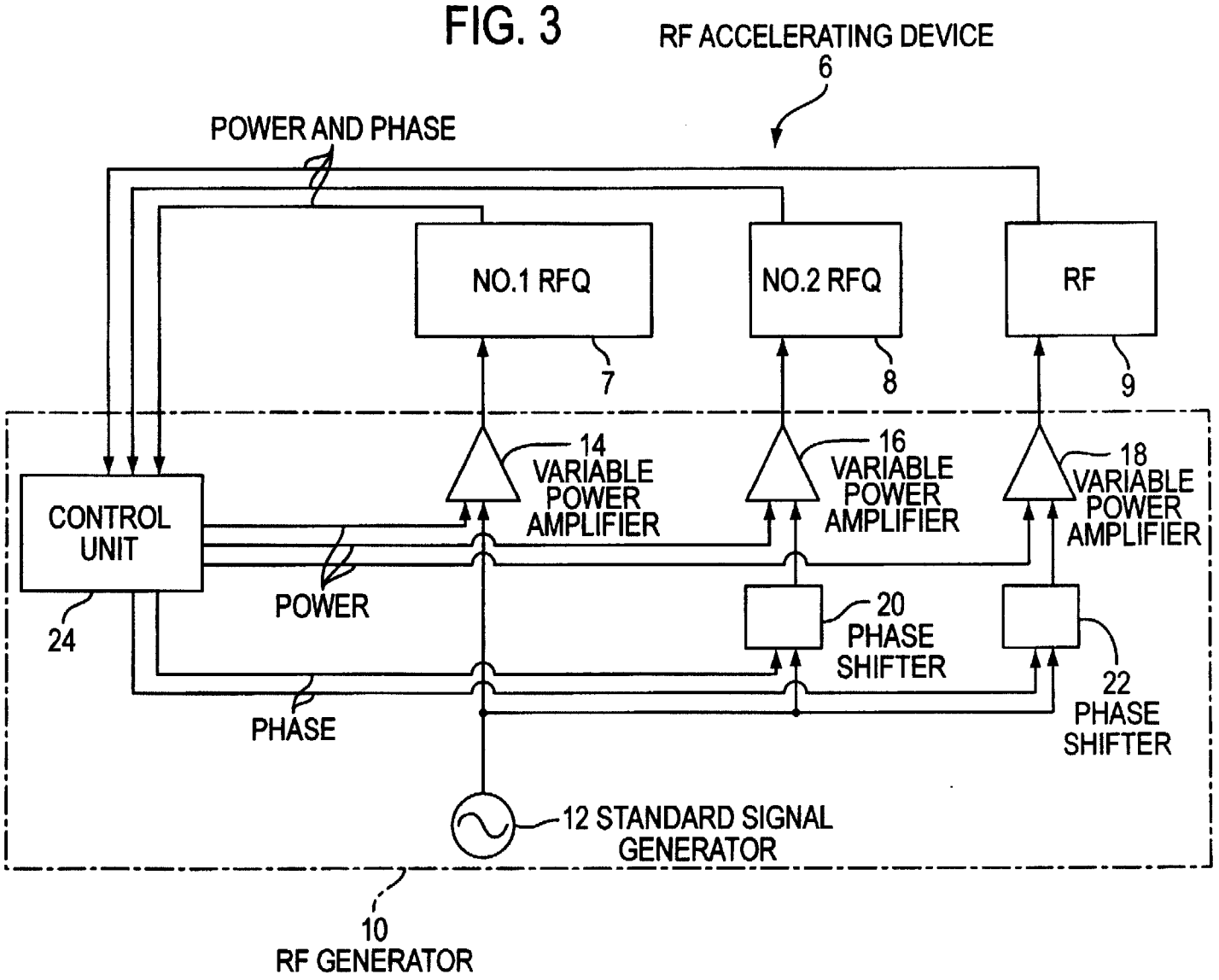
FIG. 3 is a block diagram showing the first embodiment of the present invention.

FIG. 3 is a block diagram for explaining a control operation of the RF accelerating device shown in FIG. 2. Referring to FIG. 3, the rf generator 10 is composed of a standard signal generator 12, variable power amplifiers 14, 16 and 18, phase shifters 20 and 22, and a control unit 24. The variable power amplifiers 14, 16 and 18 are respectively connected with the first RFQ accelerator 7, the second RFQ accelerator 8 and the rear stage RF accelerator 9. The standard signal generator 12 supplies a standard radio-frequency signal to these variable power amplifiers 14, 16 and 18. The phase shifters 20 and 22 are respectively connected with the second RFQ accelerator 8 and the rear stage RF accelerator 9. The control unit 24 determines respective values of the phase and the rf power, based on a predetermined programmed algorithm, to obtain a target energy which is set by an operator. That is, the control unit 24 sends control signals of the rf power to the variable power amplifiers 14, 16 and 18 so as to adjust output powers or amplitudes of electric fields. The control unit 24 sends control signals of the phase to the phase shifters 20 and 22 so as to adjust shift amounts of the accelerators 8 and 9 for accelerating the traveling ion beam. Further, the control unit 24 receives feedback signals of the rf power and the phase from the accelerators 7, 8 and 9, and corrects the differences between the set values and feedback values of the rf power and the phase by a feedback control operation.

Moreover, the control unit 24 switches a value of the rf power supplied from the variable power amplifier 16 to the second RFQ accelerator 8 between an accelerating mode and a passing-through mode. A large value of the rf power such as 20 kW is supplied from the amplifier 16 in the accelerating mode, and a small value of the rf power such as about 1–2 kW is supplied from the amplifier 16 in the passing-through mode.

Next, an operation of the RF accelerating device 6 will be explained. Rf power with a predetermined radio-frequency is applied from the rf generator 10 to the first RFQ accelerator 7, and a quadrupole electric field is established in a right angle direction to the ion beam traveling path. The ion beam coming from the ion beam generating section 1 enters into the first RFQ accelerator 7 and then is bunched in the beam bunching portion of the accelerator 7. That is, the ion beam is bunched so that the phase of the ion beam is within a predetermined range. Thereafter, the ion beam bunched at the beam bunching portion is simultaneously converged and accelerated by the beam accelerating portion of the first RFQ accelerator 7.

The beam accelerated up to a predetermined energy level by the first RFQ accelerator 7 enters into the second RFQ accelerator 8. In the second RFQ accelerator 8, the value of the rf power supplied from the rf generator 10 can be switched to both a large one and a small one, such as 20 kW and 1 kW, respectively. By such a switching operation, the second RFQ accelerator 8 can work as an accelerator or a lens.

That is, when normal rf power or accelerating rf power is supplied from the rf generator 10, the second RFQ accelerator 8 further accelerates the ion beam, accelerated by the first RFQ accelerator 7, up to a predetermined energy level. On the other hand, when a small value of the rf power or a non-accelerating rf power such as 1 kW is supplied from the rf generator 10, the second RFQ accelerator 8 focuses the ion beam but does not accelerate the ion beam, since a relatively weak quadrupole electric field is established in a right angle direction to the ion beam traveling path.

More specifically, the second RFQ accelerator 8 accelerates the bunched ion beam up to a predetermined energy level by one cell formed between a peak and a valley of a modulation or a wavy structure, and then accelerates the beam in steps up to predetermined higher energy levels by the next respective cells. During the acceleration of the ion beam, the ion beam moves with one-half cycle of a resonance frequency between one cell and the next cell. On the other hand, when the small rf power is supplied to the second RFQ accelerator 8 and therefore the electric field in the accelerator 8 is weak, the ion beam can not move with the one-half cycle of the resonance frequency between one cell and the next cell. As a result, the beam is repeatedly accelerated and decelerated when moving through the respective cells, and finally the focused and non-accelerated beam comes from the accelerator 8. That is, when the small rf power is supplied to the second RFQ accelerator 8, the accelerator 8 works only as a lens or a transportation tube.

The ion beam, further accelerated by the second RFQ accelerator 8 up to the predetermined energy level or having the energy given by the first RFQ accelerator 7, enters the rear stage RF accelerator 9.

The rear stage RF accelerator 9 can accelerate or decelerate the bunched ion beam in the triple gaps g1, g2 and g3 by changing 180 degrees in a phase relationship between the second RFQ accelerator 8 and the rear stage RF accelerator 9. Thereafter, the ion beam whose energy is adjusted by the RF accelerator 9 is impinged on the workpiece such as a semiconductor wafer.

According to the first embodiment of the present invention, the energy of the ion beam coming from the second RFQ accelerator 8 can be switched in two steps. For example, when the first RFQ accelerator 7 accelerates Boron ions ($B^+$) to 30 keV–500 keV, and the non-accelerating rf power is supplied to the second RFQ accelerator 8, the Boron ions moving from the second RFQ accelerator 8 still have the 500 keV energy. On the other hand, when the first RFQ accelerator 7 accelerates Boron ions ($B^+$) to 30 keV–500 keV, and the accelerating rf power such as 20 kW is supplied to the second RFQ accelerator 8, the Boron ions moving from the second RFQ accelerator 8 are accelerated up to 500 keV–650 keV.

Thereafter, the rear stage RF accelerator 9 changes the ion beam energy entering thereto in the two steps. Accordingly, energy having a very wide variable range can be obtained. That is, when the rear stage RF accelerator 9 has an acceleration and deceleration ability to give an energy +−150 keV to the entering ion beam, the ion beam energy moving out of the rear stage RF accelerator 9 has an energy of 500+−150 keV when the non-accelerating rf power is supplied to the second RFQ accelerator 8. Further, the ion beam energy moving out of the rear stage RF accelerator 9 has an energy of 350 keV–800 keV when the accelerating rf power is supplied to the second RFQ accelerator 8. As a result, by switching the energy supplied to the second RFQ accelerator 8 in the two steps, a continuously variable beam energy 350 keV–800 keV can be obtained by the first embodiment of the present invention.

Although it is considered that multistage RF accelerators are necessary to obtain energy having a wide variable range in a conventional device, a length of the accelerating portion of the device thus becomes very long. On the contrary, according to the first embodiment of the present invention, energy having a wide variable range can be obtained, even if the length of the acceleration portion formed by the accelerators 7, 8 and 9 is relatively short.

In the first embodiment of the present invention, two or more RF accelerators which can accelerate and decelerate the ion beam may be disposed in the rear stage side of the second RFQ accelerator 8. If this is done, since the second RFQ accelerator 8 which switches the energy in the two steps as explained above is disposed, the length of the acceleration portion of the embodiment becomes shorter than the accelerator which has not have been provided with the second RFQ accelerator 8 on the basis of obtaining the same variable scope of the energy.

Further, according to the first embodiment of the invention, the second RFQ accelerator 8 does not need the bunching portion and therefore the length of the accelerator 8 is shortened by a length equal to that of the bunching portion.

Further, according to the first embodiment of the invention, when the second RFQ accelerator 8 does not accelerate the ion beam, the accelerator 8 works as a lens by a little non-accelerating rf power being supplied thereto. As a result, the beam transmission efficiency in the second RFQ accelerator 8 does not decrease. If absolutely no accelerating rf power is supplied to the second RFQ accelerator 8, ions with the same polarity repel each other, thus causing the ion beam to diverge during traveling on the second RFQ accelerator 8. As a result, the bunched beam is destroyed, and the transmission efficiency of the beam is decreased, thus causing the beam current to be decreased.

A spiral resonator may be employed as the rear stage RF accelerator.

Figure 4:
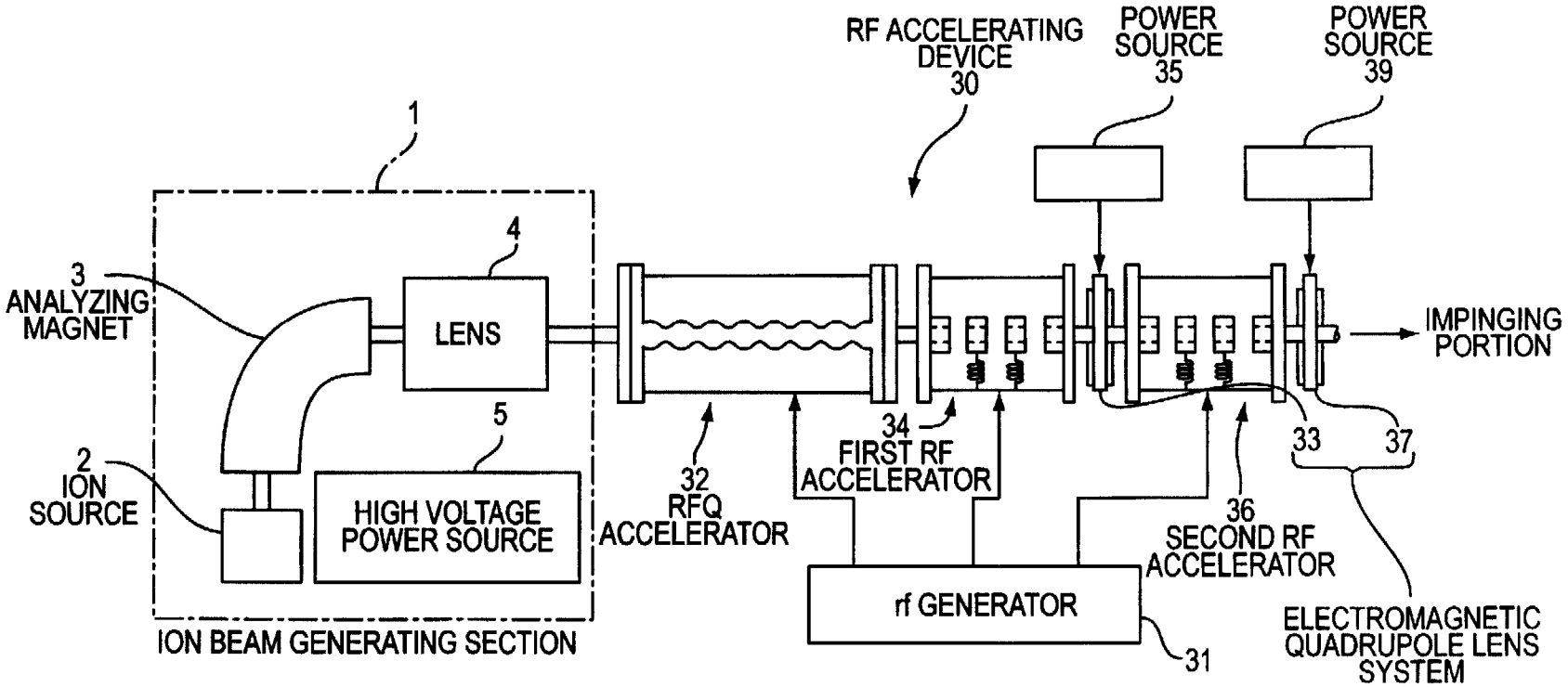
FIG. 4 is a schematic view showing a high energy ion implanter with a radio-frequency type ion accelerator which is a second embodiment of the present invention.

A second embodiment of the present invention will be explained with reference to FIGS. 4 and 5. As shown in FIG. 4, a radio-frequency type ion accelerating device 30 (hereinafter called an RF accelerating device) will be explained, such a device being a second embodiment of a radio-frequency type charged particle accelerator of the present invention. The RF accelerating device 30 is used in a high energy ion implanter, and is connected with the rear stage side of an ion beam generating section 1. The ion beam generating section 1 includes an ion source 2, an analyzing magnet 3, an electromagnetic quadrupole lens system 4, and a high voltage power source 5.

The RF accelerating device 30 is composed of an RFQ (radio frequency quadrupole) accelerator 32, a first RF (radio-frequency) accelerator 34 and a second RF accelerator 36. The RFQ accelerator 32 has a structure which is substantially the same as that of the first RFQ accelerator 7 in FIG. 2, and the first and second RF accelerators 34 and 36, respectively, have structures which are substantially the same as that of the rear stage RF accelerator 9 in FIG. 2. The accelerating device 30 further comprises two electromagnetic quadrupole lens systems 33 and 37, which are disposed on the downstream side of the RFQ accelerator 32 and in rear stage sides of the first and second RF accelerators 34 and 36 respectively. The lens systems 33 and 37 are respectively connected with direct current (DC) power sources 35 and 39. The electromagnetic quadrupole lens systems 33 and 37 respectively establish variable magnetic fields. Therefore, permanent magnet quadrupole lens systems may be employed instead of the electromagnetic quadrupole lens systems 33 and 37.

The RF accelerating device 30 further includes a rf generator 31 for supplying a rf power to the RFQ accelerator 32, the first RF accelerator 34 and the second RF accelerator 36. The rf power supplied to the RFQ accelerator 32 can be switched to both a large value and a small value. Further, the rf power supplied to the first and second RF accelerators 34 and 36 can be switched to ON and OFF. Thus, the RFQ accelerator 32 works as an accelerator (a high energy mode) or a transportation tube (a low energy mode).

Figure 5:
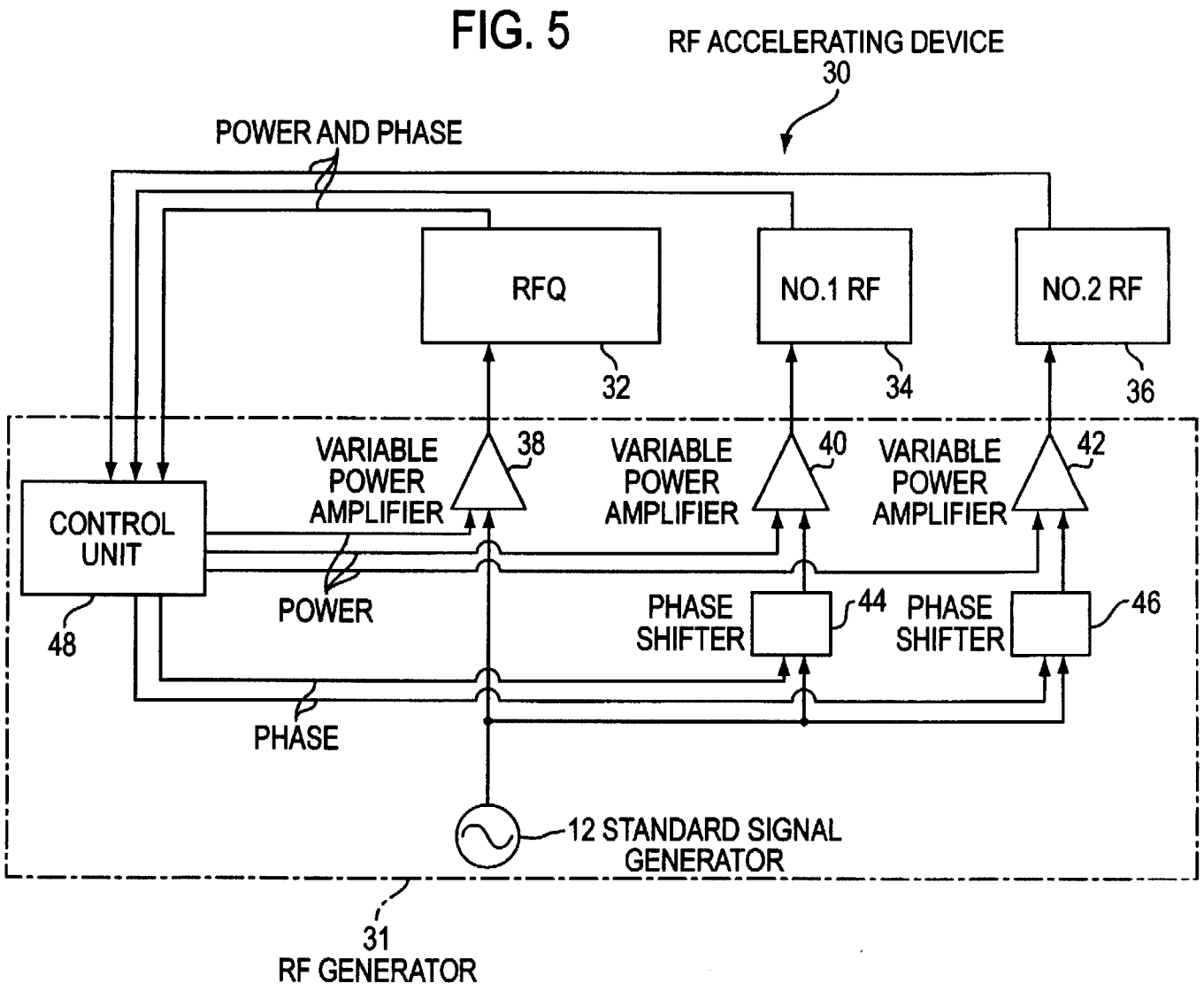
FIG. 5 is a block diagram showing the second embodiment of the present invention.

FIG. 5 is a block diagram for explaining a control operation of the RF accelerating device 30 shown in FIG. 4. Referring to FIG. 5, the rf generator 31 is composed of a standard signal generator 12, variable power amplifiers 38, 40 and 42, phase shifters 44 and 46, and a control unit 48. The variable power amplifiers 38, 40 and 42 are respectively connected with the RFQ accelerator 32, the first RF accelerator 34 and the second RF accelerator 36. The standard signal generator 12 supplies a standard radio-frequency signal to these variable power amplifiers 38, 40 and 42. The phase shifters 44 and 46 are respectively connected with the first RF accelerator 34 and the second RF accelerator 36. The control unit 48 determines respective values of the phase and the rf power, based on a predetermined programmed algorithm, to obtain a target energy which is set by an operator. That is, the control unit 48 sends control signals of the rf power to the variable power amplifiers 38, 40 and 42 so as to adjust output powers or amplitudes of electric fields. The control unit 48 sends control signals of the phase to the phase shifters 44 and 46 so as to adjust shift amounts of the accelerators 34 and 36 for accelerating the traveling ion beam. Further, the control unit 48 receives feedback signals of the rf power and the phase from the accelerators 32, 34 and 36, and corrects the differences between the set values and feedback values of the rf power and the phase by a feedback control operation.

Moreover, the control unit 48 switches a value of the rf power supplied from the variable power amplifier 38 to the RFQ accelerator 32 so it can be both in the high energy mode and the low energy mode. The RFQ accelerator 32 works as an accelerator in the high energy mode and works as a transportation tube in the low energy mode. In the low energy mode, no rf power is supplied to the first and second RF accelerators 34 and 36.

More specifically, the variable power amplifier 38 is adjusted so as to supply, for example, 20–30 kW rf power to the RFQ accelerator 32 in the high energy mode and is adjusted so as to supply, for example, about 1–2 kW power to the RFQ accelerator 32 in the low energy mode. A rf power for acceleration and deceleration is supplied to the first and second RF accelerators 34 and 36 through the variable power amplifiers 40 and 42 in the high energy mode, and no rf power is supplied to the first and second RF accelerators 34 and 36 in the low energy mode.

Next, an operation of the RF accelerating device 30 will be explained. In the high energy mode, rf power such as 20–30 kW with a predetermined radio-frequency is supplied from the rf generator 31 to the RFQ accelerator 32, and a quadrupole electric field is established in a right angle direction to the ion beam traveling path. The ion beam coming from the ion beam generating section 1 enters into the RFQ accelerator 32 and then is bunched in the beam bunching portion of the accelerator 32. That is, the ion beam is bunched so that the phase of the ion beam is within a predetermined range. Thereafter, the ion beam bunched at the beam bunching portion is simultaneously converged and accelerated in the beam accelerating portion of the RFQ accelerator 32.

The beam accelerated up to a predetermined energy level by the RFQ accelerator 32 enters into the first RF accelerator 34. The ion beam accelerated by the RFQ accelerator 32 up to the predetermined energy level is further accelerated or decelerated by the first RF accelerator 34. Thereafter, the bunch ion beam enters the second RF accelerator 36 through the electromagnetic lens system 33. The beam is again accelerated or decelerated by the second RF accelerator 36 and then moves through the electromagnetic lens system 37. Finally, the ion beam is impinged on the workpiece such as a semiconductor wafer.

In the low energy mode, a non-accelerating rf power such as one-tenth to one-twentieth of the normal rf power (20 k–30 kW) is applied from the rf generator 31 to the RFQ accelerator 32, and therefore a weak quadrupole electric field is established in a right angle direction against the ion beam traveling path. The ion beam can not be accelerated in steps because the weak accelerating electric field has been established. As a result, the ion beam is neither accelerated nor decelerated by the RFQ accelerator 32, and thus the ion beam enters into the first RF accelerator 34 having the same energy as when it enters the accelerator 32. The ion beam entering the accelerator 34 is not bunched and is a direct current.

Thereafter the ion beam travels through the first RF accelerator 34, the electromagnetic lens system 33, the second RF accelerator 36 and the electromagnetic lens system 37. Since no rf power is supplied to the first and second RF accelerators 34 and 36 in the low energy mode, the ion beam is neither accelerated nor decelerated, and only both of the electromagnetic lens systems 33 and 37 are working. According to the second embodiment, since the electromagnetic lens systems instead of electrostatic lenses are employed as the lens system 33 and 37, a space charge effect is decreased and therefore the beam divergence can be avoided. As a result, relatively many ions can be introduced into the impinging portion.

According to the second embodiment of the present invention, since the RFQ accelerator 32 accelerates the ion beam and then the first and second RF accelerators 34 and 36 further accelerate or decelerate the ion beam which is accelerated by the RFQ accelerator in the high energy mode, a variable scope of the energy can be expanded. Further, according to the second embodiment, in the low energy mode, since the non-accelerating rf power is supplied to the RFQ accelerator 32 and no rf power is supplied to the first and second RF accelerators 34 and 36, the ion beam moves out of the RFQ accelerator 32 having the same energy as when it enters the accelerator 32 and then moves through the first and second RF accelerators 34 and 36. As a result, according to the second embodiment, in addition to the high energy region, the RF accelerating device can be used in the low energy region where it is very difficult to use the conventional RF accelerating device.

Next, the third embodiment of the present invention will be explained with reference to FIGS. 6 and 7.

Figure 6:
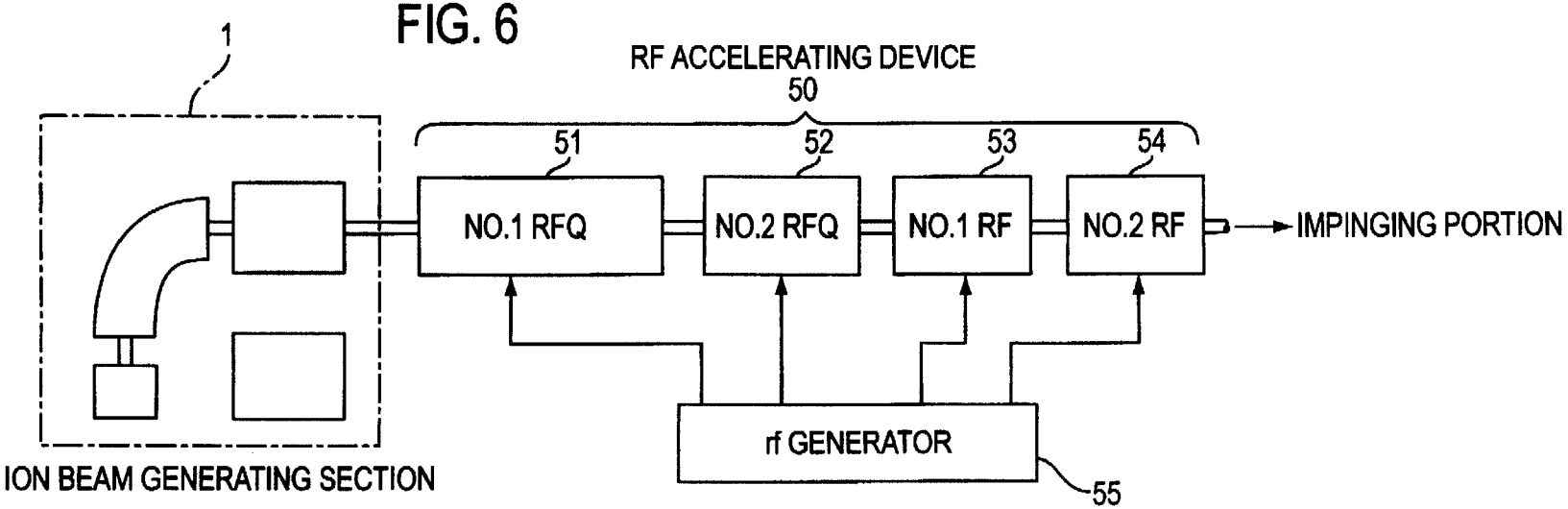
FIG. 6 is a schematic view showing a high energy ion implanter with a radio-frequency type ion accelerator which is one example of a third embodiment of the present invention.

FIG. 6 shows one example of the third embodiment of the present invention. Referring to FIG. 6, an RF accelerating device 50 is connected with the rear stage side of the ion beam generating section 1. The RF accelerating device 50 comprises a first RFQ accelerator 51, a second RFQ accelerator 52, a first RF accelerator 53, a second RF accelerator 54 and a rf generator 55. The structures of the first and second RFQ accelerators 51 and 52 are substantially the same as those of the first and second RFQ accelerators 7 and 8 in FIG. 2, and the structures of the first and second RF accelerators 53 and 54 are substantially the same as that of the rear stage RF accelerator 9 in FIG. 2. Further the rf power source 55 is substantially the same as the rf generator 10 in FIG. 2.

The RF accelerating device 50 is constructed so that an intermediate energy mode can be carried out in addition to the high energy mode including the accelerating mode and the passing through mode explained above with reference to FIGS. 2 and 3. That is, in the intermediate energy mode, a non-accelerating rf power such as about 1–2 kW is supplied from the rf generator 55 to the first and second RFQ accelerators 51 and 52, and a predetermined rf power is supplied to the first RF accelerator 53 so as to work as a buncher and further a predetermined rf power is supplied to the second RF accelerator 54 so as to work as an accelerator. Thus, the RF accelerating device 50 can work in the intermediate energy mode in addition to the high energy mode.

Figure 7:
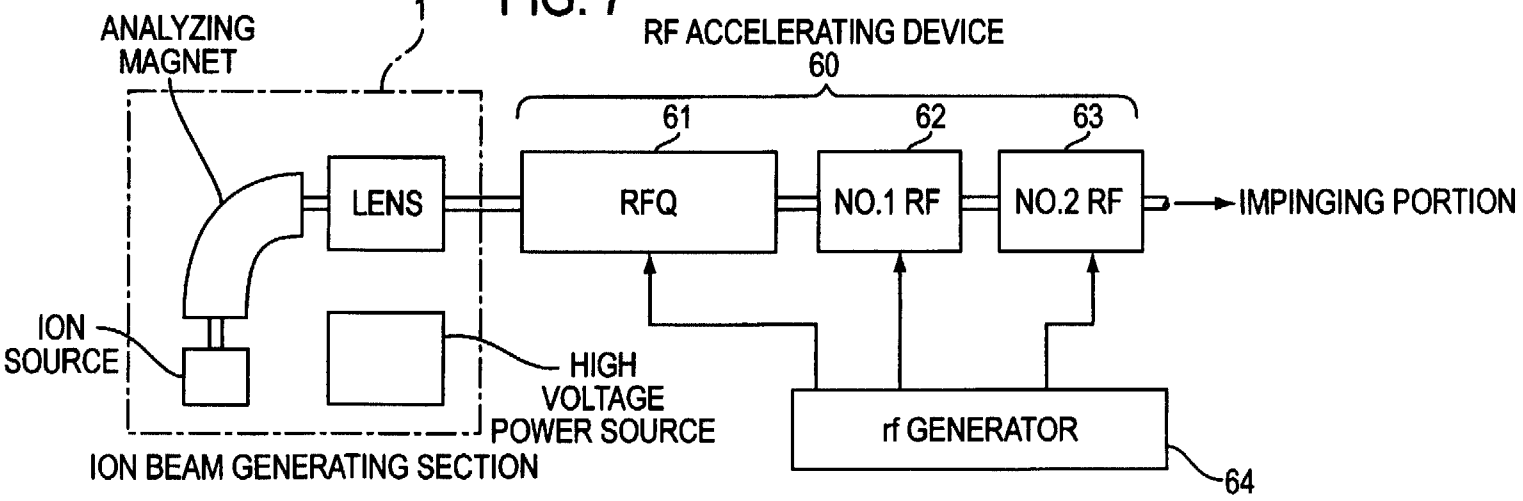
FIG. 7 is a schematic view showing a high energy ion implanter with a radio-frequency type ion accelerator which is another example of a third embodiment of the present invention.

FIG. 7 shows another example of the third embodiment of the present invention. Referring to FIG. 7, an RF accelerating device 60 is connected with the rear stage side of the ion beam generating section 1. The RF accelerating device 60 comprises a RFQ accelerator 61, a first RF accelerator 62, a second RF accelerator 63 and a rf power source or a rf generator 64. The structures of the RFQ accelerator 61 is substantially the same as that of the RFQ accelerator 32 in FIG. 4, and the structures of the first and second RF accelerators 62 and 63 are substantially the same as those of the first and second RF accelerators 34 and 36 in FIG. 4. Further the rf generator 64 is substantially the same as the rf generator 31 in FIG. 4.

The RF accelerating device 60 is constructed so that an intermediate energy mode can be carried out in addition to the high energy mode and the low energy mode which are explained above with reference to FIGS. 4 and 5. That is, in the intermediate energy mode, a non-accelerating rf power such as about 1–2 kW is supplied from the rf power source 64 to the RFQ accelerator 61, and a predetermined rf power is supplied to the first RF accelerator 62 so as to work as a buncher and further a predetermined rf power is supplied to the second RF accelerator 63 so as to work as an accelerator. Thus, the RF accelerating device 60 can work in the intermediate energy mode in addition to the high energy mode and the low energy mode.

The above-mentioned embodiments of the radio-frequency type charged particle accelerator of the present invention are applied to a high energy ion implanter. However, the present invention may also be applied to other devices.

While the present invention has been illustrated by means of preferred embodiments, one of ordinary skill in the art will recognize that modification and improvements can be made while remaining within the spirit and scope of the invention. The scope of the invention is determined solely by the appended claims.

What is claimed is:

1. A radio-frequency type charged particle accelerator, comprising:

a radio-frequency power source comprising at least one variable sower amplifier;

first RFQ accelerating means, including quadrupole electrodes positioned along a traveling path of a charged particle beam, for bunching and accelerating the charged particle beam by receiving a first radio-frequency power from said radio-frequency power source and resonating;

rear stage RF means disposed in the path of said charged particle beam downstream from the first RFQ accelerating means for optionally changing the energy of the charged particle beam by receiving a second radio-frequency power from said radio-frequency power source and resonating;

second RFQ accelerating means disposed between the first RFQ accelerating means and the rear stage RF means along the traveling path of the charged particle beam, including quadrupole electrodes positioned along the traveling path of the charged particle beam, for optionally accelerating the charged particle beam by receiving a third radio-frequency power from said radio-frequency power source and resonating; and means for switching between an accelerating mode by supplying a predetermined accelerating radio-frequency power as the third radio-frequency power to said second RFQ accelerating means and a passing-through mode by supplying a predetermined non-accelerating radio-frequency power as the third radio-frequency power to the second RFQ accelerating means, wherein said means for switching comprises a control unit configured to output control signals to said variable power amplifier of said radio-frequency power source that cause said variable power amplifier to switch between a first state, for outputting the predetermined accelerating radio-frequency power, and a second state, for outputting the predetermined non-accelerating radio-frequency power.

2. An accelerator according to claim 1, wherein said rear stage RF means optionally decelerates or further accelerates the charged particle beam travelling from the second RFQ accelerating means.

3. An accelerator according to claim 1, wherein said rear stage RF means includes a pair of cylindrical accelerating electrodes and earth electrodes, a first earth electrode of said pair of earth electrodes being disposed on a first side of the cylindrical accelerating electrodes and a second earth electrode of said pair of earth electrodes being disposed on a second side of the cylindrical accelerating electrodes.

4. An accelerator according to claim 1, wherein a resonance frequency of the rear stage RF means is a predetermined fixed frequency.

5. An accelerator according to claim 1, wherein said first RFQ accelerating means includes a beam bunching portion and a beam accelerating portion, and said second RFQ accelerating means includes a beam accelerating portion.

6. A radio-frequency type charged particle accelerator, comprising:

a radio-frequency power source comprising at least one variable power amplifier;

RFQ accelerating means, including quadrupole electrodes positioned along a traveling path of a charged particle beam, for bunching and accelerating the charged particle beam by receiving a first radio-frequency power from said radio-frequency power source and resonating;

rear stage RF means disposed in the path of said charged particle beam downstream from the RFQ accelerating means for optionally changing the energy of the charged particle beam by receiving a second radio-frequency power from said radio-frequency power source and resonating; and means for switching between a high energy mode by supplying predetermined accelerating radio-frequency powers as the first and second radio-frequency powers to the RFQ accelerating means and the rear stage RF means and a low energy mode by supplying a predetermined non-accelerating radio-frequency power as the first radio-frequency power to the RFQ accelerating means and no radio-frequency power to the rear stage RF means, wherein said means for switching comprises a control unit configured to output control signals to said variable power amplifier of said radio-frequency power source that cause said variable power amplifier to switch between a first state, for outputting the predetermined accelerating radio-frequency power, and a second state, for outputting the predetermined non-accelerating radio-frequency power.

7. An accelerator according to claim 6, wherein the accelerator further comprises a first electromagnetic quadrupole lens system for focusing the charged particle beam and a second electromagnetic quadrupole lens system for focusing the charged particle beam, both of said lens systems being disposed in the path of said charged particle beam downstream of said RFO accelerating means.

8. An accelerator according to claim 6, wherein when said accelerator is in said high energy mode said rear stage RF means optionally decelerates or further accelerates the charged particle beam coming from the RFQ accelerating means.

9. An accelerator according to claim 6, wherein said rear stage RF means includes a pair of cylindrical accelerating electrodes and earth electrodes, a first earth electrode of said pair of earth electrodes being disposed on a first side of the accelerating electrodes and a second earth electrode of said pair of earth electrodes being disposed on a second side of the accelerating electrodes.

10. An accelerator according to claim 6, wherein a resonance frequency of the rear stage RF means is a predetermined fixed frequency.

11. An accelerator according to claim 6, wherein said rear stage RF means includes a first RF accelerator and a second RF accelerator.

12. A radio-frequency type charged article accelerator, comprising:

RFQ accelerating means, including quadrupole electrodes positioned along a traveling path of a charged particle beam, for bunching and accelerating the charged particle beam by receiving a first radio-frequency power from a radio-frequency power source and resonating;

rear stage RF means disposed in the path of said charged particle beam downstream from the RFQ accelerating means for optionally changing the energy of the charged particle beam by receiving a second radio-frequency power from the radio-frequency power source and resonating, said rear stage RF means including a plurality of multistage accelerators; and means for switching between a high energy mode by supplying predetermined accelerating radio-frequency powers as the first and second radio-frequency powers to said RFQ accelerating means and said rear stage RF means, respectively, a second, intermediate energy mode by supplying a predetermined non-accelerating radio-frequency power as the first radio-frequency power to said RFQ accelerating means, a predetermined radio-frequency power to a first stage of the plurality of multistage accelerators to cause said first stage to work as a buncher and a predetermined accelerating radio-frequency power to subsequent stages of the plurality of multistage accelerators to cause said subsequent stages to work as accelerators, and a third, low energy mode by supplying a predetermined non-accelerating radio-frequency power as the first radio-frequency power to said RFQ accelerating means and no radio-frequency power to said rear stage RF means.

13. An accelerator according to claim 12, wherein said RFQ accelerating means includes a first RFQ accelerator having a beam bunching portion and a beam accelerating portion, and a second RFQ accelerator having a beam accelerating portion.

14. An accelerator according to claim 12, wherein when said accelerator is in said high energy mode or said intermediate energy mode said rear stage RF means optionally decelerates or further accelerates the charged particle beam coming from the RFQ accelerating means.

* * * * *